United States Patent [19]

Jurkov et al.

[11] Patent Number: 4,765,840

[45] Date of Patent: Aug. 23, 1988

[54] COMPOSITION FOR DEPOSITING DIFFUSION CARBIDE COATINGS ON IRON-CARBON ALLOY ARTICLES

[75] Inventors: Igor I. Jurkov; Gennady A. Melnichuk; Natalya V. Stepanova, all of Moscow; Viktor I. Juschenko, Sumskoi; Viktor I. Derkach, Sumskoi; Ivan I. Levchenko, Sumskoi; Vladimir M. Eremenko, Sumskoi, all of U.S.S.R.

[73] Assignees: Nauchno-Issledovatelsky Institut Tekhnologii Avtomobilnoi Promyshlennosti, Moscow; Svessky Nasosny Zavod, Poselok Svessa, both of U.S.S.R.

[21] Appl. No.: 43,831

[22] Filed: Apr. 28, 1987

[51] Int. Cl.[4] ..... C09D 3/00

[52] U.S. Cl. ..... 106/285; 501/87

[58] Field of Search ..... 106/285, 287; 501/87

[56] References Cited

U.S. PATENT DOCUMENTS

| | | | |
|---|---|---|---|
| 3,859,405 | 1/1975 | Hurton | 106/38.3 |
| 4,041,196 | 8/1977 | Baldi | 427/252 |
| 4,208,453 | 6/1980 | Baldi | 427/237 |
| 4,617,202 | 10/1986 | Baldi | 427/253 |

OTHER PUBLICATIONS

Chem. Abst., 68:15,549p, 1968–Foresco Trading.
Claims of SU 761602.
Claims of SU 590,339.
Claims of JP 55-164072.
Claims of JP 57-110,664.
Claims of SU 956,615.

*Primary Examiner*—Theodore Morris
*Attorney, Agent, or Firm*—Ladas & Parry

[57] ABSTRACT

The composition comprises a carbide-forming element, a carbon-containing compound selected from the class of hydrocarbons, having a boiling or sublimation point of 180° to 750°0 C., staying in a solid state at room temperature, an activator and an inert filler, mass %:

| | |
|---|---|
| carbide-forming element | 40–70 |
| carbon-containing compound | 0.5–2.5 |
| activator | 0.2–5.0 |
| inert filler | the balance |

It is recommended that the function of the carbon-containing compound be performed by diphenyl, naphthalene, anthracene, the function of activator, by halogen-containing ammonium salts, and the function of inert filler, by aluminum oxide, magnesium oxide or silicone dioxide.

16 Claims, No Drawings

COMPOSITION FOR DEPOSITING DIFFUSION CARBIDE COATINGS ON IRON-CARBON ALLOY ARTICLES

INDUSTRIAL FIELD TO BE APPLIED

The present invention relates to metallurgy, is concerned with thermochemical treatment of metals and alloys and, more particularly, with compositions for depositing diffusion carbide coatings on iron-carbon alloy articles.

To extend durability and service life of the parts, machines and mechanisms subjected to heavy wear, they are diffusion-saturated thus producing a diffusion coating on the surface of the articles. This coating should feature higher hardness and wear resistance than those of the material of the article. These requirements are met most fully by the carbide-type diffusion coatings.

PRIOR ART

The most universally preferred in practice are saturating powder compositions for depositing wear-resistant diffusion carbide-chromium coatings containing the powders of chromium, inert filler and activator.

Known in the prior art is the formula of a composition for diffusion chromium plating which contains 10% chromium with particle size 10–20 μm, 89% aluminium oxide $Al_2O_3$; particle size 100–300 μm and 0.5% granular ammonium chloride $NH_4Cl$. To avoid agglomeration of the composition it is suggested that the particles of $Al_2O_3$ be of a spherical or laminar form which imparts high looseness to the composition, ensures high adaptability of the mixture to production and reduces the labour content of the diffusion chromium plating process. Saturation at 980° in the course of 10 h has produced a carbide-chromium layer 45–μm thick (Baldi Alfonso L. Modified diffusion coating of the interior of a steam boiler tube; U.S. Pat. No. 4,208,453, NPC 427/237, IPC C23C 11/04, published 17.06.80).

Also known in the prior art is a chrome-plating composition comprising 10–40% chromium, 6–20% intermetallic compound $Ni_3Al$, inert filler in the form of aluminium oxide $Al_2O_3$ and activator in the form of ammonium chloride $NH_4Cl$ (U.S. Pat. No. 4,041,196, IPC C23C 9/00, published 9.08.77).

However, the compositions of the chrome-plating mixtures cited above envisage the process of diffusion chrome-plating taking place in a nonoxidizing atmosphere created in the saturating container by feeding hydrogen thereto. The carbide-chromium coatings consisting from the above-cited chromium-plating mixtures are noted for high wear resistance, good surface quality and a sufficiently high deposition rate but all these merits are due mostly to the use of a hydrogen atmosphere during diffusion chromium plating which complicates the process and calls for special equipment and additional measures ensuring explosion and fire safety.

A diffusion chromium-plating composition developed in the USSR also ensures a high deposition rate of the carbide-chromium coating but without resorting to the protective atmosphere. The chromium-containing agents in said composition are chromium carbides (45–65%), iron oxide (25–50%) and ammonium chloride (3–10%). But introduction into the composition of chromium carbides steps up considerably the cost of such a saturating composition and in some cases renders its use unwarranted economically (Inventor's Certificate of the USSR No. 761602, IPC C23C 9/02, published 7.09.80).

Another saturating composition known in the previous art consists of the powders of at least one oxide of carbide-forming metals such as titanium, niobium, vanadium, tantalum and chromium, and fluoborates. Such a composition imparts high tribological properties to the carbide coating but calls for additional cleaning of the treated surfaces on completion of diffusion saturation which increases the labour content required in the process (Japan, Application No. 57-110664, IPC C23C 9/02, published 9.07.82).

The introduction into the saturating composition of the carbon-containing components which ensure diffusion of carbon atoms into the surface layer of the article in the process of diffusion saturation increases considerably the wear resistance of such carbide coatings. A powder composition for diffusion carbochromium plating proposed in the USSR contains 50–65% of chromium powder, 0.3–1.0% of Bondiuzhsky carburizer containing 74–78 mass % of charcoal, 12–15 mass % $BaCO_3$, 1.0–1.5% mass $Na_2CO_3$, 3–5 mass % $CaCO_3$, 4.5–5.0 mass % fuel oil, under 6 mass % $H_2O$, under 0.1 mass % S, under 0.5 mass % $SiO_2$, 1–5 mass % ammonium chloride $NH_4Cl$, the balance being aluminium oxide. The proposed composition ensures a 29% increase in the hardness of the carbide-chromium layer and a higher wear resistance but at a sharp sacrifice in the carbide layer deposition rate. (Inventor's Certificate of the USSR No. 956615, IPC C23C9/02, published 1982).

Known in the prior art is the use of carbon-containing organic compounds for depositing carbide coatings. Patented in Switzerland is a method for depositing diffusion coatings on metals said coatings consisting of carbides, titanium carbonitrides and nitrides, silicone, vanadium, chromium, zirconium, niobium, molybdenum, iron and born by direct thermal reaction with carbon and nitrogen. The adhesion properties of the coating are improved and its forming time is reduced by the use of a halogen-containing organic compound as the source of carbon and nitrogen.

The formula of the halogen-containing organic compound includes 2,4,5,6-tetrachloropyrimidine; 2,4,6-tribromo- or trichloropyrimidine; 2,4-dichloropyrimidine; 2,4-dichloro-6-methyl-6-isopropyl or-6-phenylpyrimidine; 2,4-dibromo-6-cyan-pyramidine, etc. (Swiss Pat. No. 590339 IPC C23C11/14, published 15.08.77).

To speed up the formation of diffusion carbonitride and nitride coatings the compounds containing carbon and nitrogen are known to be constituted by metallo-organic compounds of the group of amines of transition metals with a general formula $(R_1R_2N)_nM$, where $R_1$ and $R_2$ are hydrocarbon radicals, M is transition metal (it may also be aluminium, boron, silicone). For making a coating utilizing such a compound the active gaseous medium is formed on contact of metallo-organic compounds with a high-temperature plasma. The active gaseous medium is delivered to the surface of the work by the stream of carrier gas, e.g. hydrogen, nitrogen or argon. The plasma is produced by a high-frequency discharge in rarefied gas, excitation being provided by an inductor supplied from a high-frequency generator. (Application of Japan No. 54-72829, IPC C23C 11/08, published 20.12.80).

It should be noted that the use of organic carbon- and nitrogen-containing compounds for speeding up the coating deposition rate calls for the use of special vacuum and gas systems which complicates substantially the coating deposition process.

SUBJECT OF THE INVENTION

An object of the present invention lies in developing a composition for depositing a diffusion carbide coating on iron-carbon alloy articles which would improve the quality of the coating and extend the service life of wearing articles and which would dispense with the necessity for gas and vacuum systems.

BRIEF DESCRIPTION OF THE SUBJECT MATTER

This object has been achieved by providing a composition for depositing a diffusion carbide coating on iron-carbon alloy articles comprising a carbide-forming element, a carbon-containing compound selected from the class of hydrocarbons, whose boiling or sublimation point ranges from 180° to 750° C., which is in a solid state at room temperature, an activator and an inert filler, said components mixed in the following proportion, mass %:

| | |
|---|---|
| carbide-forming element | 40–70 |
| carbon-containing compound | 0.5–2.5 |
| activator | 0.2–5.0 |
| inert filler | the balance |

It is recommended that the carbon-containing compound be constituted by diphenyl, naphthalene, anthracene; the activator, by halogen-containing ammonium salts, and the inert filler, by aluminium oxide, magnesium oxide, silicone dioxide as being more available and inexpensive.

The effect of the given composition consists in improving the quality of the diffusion carbide coating and its physicomechanical and physicochemical properties which extends the service life of wearing parts. This composition enables ordinary carbon steels to be used for making said parts instead of high-strength high alloys in short supply.

The above-quoted advantages will become apparent from the following description of the composition for depositing diffusion carbide coatings on iron-carbon alloy articles.

The composition for these coatings contains a carbide-forming element, a carbon-containing compound, an activator and an inert filler in the form of powders with a dispersity of 16–12 mesh.

The carbide-forming element may be constituted by chromium, molybdenum, tungsten, niobium, zirconium, tantalum, silicone.

The function of the carbon-containing compound is performed, according to the invention, by a hydrocarbon with a boiling or sublimation point ranging from 180° to 750° C. which is in a solid state at room temperature. Such a hydrocarbon may be naphthalene, anthracene, diphenyl, pyrene. The activator is a substance which, when it is decomposed and interacts with a carbide-forming element, generates an active gaseous medium. The function of the activator is performed by ammonium chloride, ammonium fluoride, ammonium bromide, ammonium iodide.

The inert filler can be represented by aluminium oxide, magnesium oxide, silicone dioxide, kaolin, refractory clay and other suitablle inert fillers that prevent agglomeration of the particles of the carbide-forming element and their sticking to the surfaces of articles.

The above-listed components are separately disintegrated and sifted to produce a fraction with a particle size of 16–12 mesh. Then the components are weighed out according to the following formula, mass %:

| | |
|---|---|
| carbide-forming element | 40–70 |
| carbon-containing compound | 0.5–2.5 |
| activator | 0.2–5.0 |
| inert filler | the balance |

Then the above components are dried under certain conditions governed by the nature of the component. The powder of the carbide-forming element is dried at 140° C. for 4 h. The powder of the carbon-containing compound is dried at 60° C. for 0.5–1 h. The powder of the activator is dried at 140° C. for 4 h. And the powder of the inert filler is dried at 1200° C. for 2 h. Then the dried components are cooled to 20°–40° C. and thoroughly mixed.

The moisture content in the obtained composition should not run higher than 5–6%.

The prepared composition is loaded into a stainless-steel container and the iron-carbon alloy articles are immersed into the composition, leaving a distance of at least 20 mm between the container bottom and the articles, at least 10 mm from the side walls of the container to the articles, at least 15 mm between the articles and at least 30 mm between the articles and the first container cover.

After immersing the articles into the composition, the container is closed with the first stainless steel cover with a layer of quartz sand at least 30 mm deep poured on top of it. Then the container is closed with the second stainless steel cover and a layer of boric oxide $B_2O_3$ at least 10 mm deep is poured on top of it.

The container is placed into a resistance furnace and heated to a temperature of 950°–1100° C. At this temperature said carbon-containing compound is decomposed into saturated hydrocarbons and free carbon which, interacting with oxygen in the container forms carbon dioxide. This heating is also accompanied by the decomposition of halogen-containing activator into hydrogen halide and ammonia.

The mechanism of chemical reactions can be elucidated by an example of the composition consisting of chromium, diphenyl, ammonium fluoride and aluminium oxide. Being an inert filler, the aluminium oxide takes no part in the chemical reactions.

In the course of heating, beginning with a temperature of about 256° C., diphenyl is decomposed:

$$2C_{12}H_{10} \rightarrow 5CH_4 + 19C \quad (1)$$

Carbon reacts with oxygen inside the container:

$$C + O_2 \rightarrow CO_2 \quad (2)$$

Beginning from 335° C. ammonium fluoride is decomposed:

$$NH_4F \rightarrow NH_3 + HF \quad (3)$$

$$2NH_3 \rightarrow N_2 + 3H_2 \quad (4)$$

Then saturated hydrocarbon (methane) formed during decomposition of diphenyl interacts with a part of hydrogen fluoride forming carbon tetrafluoride which is adsorbed by the surface of the article, forming active atoms of carbon saturating the surface of the article:

$$CH_4+4HF \rightarrow CF_4+4H_2 \quad (5)$$

$$CF_4+4Fe \rightarrow 2FeF_2+C \quad (6)$$

As temperature reaches 450° C., boric oxide $B_2O_3$ starts melting, sealing off the container.

At 814° C. chromium starts evaporating and interacts with hydrogen fluoride, creating an active gaseous medium for diffusion saturation:

$$Cr+2HF \rightarrow CrF_2+H_2 \quad (7)$$

Chromium fluorides are adsorbed by the surface of the article then are diffused into the surface layer of the article.

$$CrF_2+Fe \rightarrow FeF_2+Cr \quad (8)$$

$$CrF_2+H_2 \rightarrow 2HF+Cr \quad (9)$$

Chromium atoms interacting with carbon diffused into the surface of the article during decomposition of diphenyl form a diffusion carbide coating by the reaction:

$$23Cr+6C \rightarrow Cr_{23}C_6 \quad (10)$$

Reactions (7), (10) are most intensive within a temperature interval from 950° to 1100° C. As temperature reaches these values, the articles are held heated from 2 to 8 h which is accompanied by intensive formation of the diffusion carbide coating. On expiration of this time the container is taken out of the resistance furnace and cooled down to room temperature. Then it is opened and the finished articles are discharged.

The deposited coating is silvery grey in colour, their surface roughness Ra is not over 0.32 μm; on completion of the process the coated article requires no dressing nor subsequent machining. The coating adheres effectively to the article.

The composition consists of cheap components and the process of deposition does not require vacuum equipment and protective gas atmosphere which call for special measures of fire and explosion safety. The physicomechanical and physicochemical properties of the coating are as follows:

| carbide costing is dense, i.e. devoid of pores; | |
|---|---|
| thickness of carbide coating | 22–24 μm |
| microhardness of carbide coating | 24–27 GPa |
| hardness of base material | 4.2–7.4 GPa |
| minimum hardness in sublayer (decarburized) zone | 4.2–7.4 GPa |
| depth of decarburized zone | 0–6 μm |
| relative wear rate of coating subjected to sliding friction | 12.5–16.0 $g/m^2 \cdot s$ |
| corrosion resistance in 20% aqueous solution of $H_2SO_4$ | 0.0040–0.0070% |
| cavitation resistance | 130–150 $mg/cm^2$. |

An increase in such physicomechanical characteristics of the coating as wear resistance in sliding friction, microhardness and thickness of the coating and a small thickness or absence of the decarburized zone under the coating became possible thanks to the introduction into the composition of a carbon-containing compound with a boiling or sublimation temperature of 180°–750° C. and staying in a solid state at room temperature.

The coating with high physicomechanical and physicochemical properties can be produced by the use of the herein-proposed composition. If the quantity of even one of the components is not strictly observed, any attempts at reaching the sought-for result will be futile.

If the content of the carbide-forming element is below 40 mass % the thickness of the carbide coating will be reduced while its content exceeding 70 mass % will result in sintering of the composition when heated to 950°–1100° C. which hinders the extraction of the articles from the composition on completion of the process.

The amount of said carbon-containing compound below 0.5 mass % reduces the wear rate of the coating in sliding friction while its amount exceeding 2.5 mass % increases the microhardness of the coating to 31.0 GPa thus making it brittle which is impermissible.

The activator content below 0.2 mass % reduces the thickness of the carbide coating while its content exceeding 5 mass % impairs the surface roughness and increases the brittleness of the coating.

The used composition can be reclaimed and reused as many as 15 times. Reclaiming consists in the following. The used composition is ground, sifted through a vibrosieve to obtain a fraction with particle size of 16–12 mesh, weighed and dried for 4 h at 140° C. Then 0.5–2.5 mass % of a dried carbon-containing compound, 0.2–5.0 mass % of activator and 10 mass % of freshly prepared and dried composition are added to it (percentage is given with relation to the composition being reclaimed). Then all the above-listed components are vigorously mixed and the composition is ready for use.

For better understanding of the present invention, it is illustrated by examples illustrating the constitution, preparation and use of the composition.

EXAMPLE 1

Starting components: chromium, diphenyl, ammonium chloride and aluminium oxide are ground, sifted through a vibrosieve 16–12 mesh, and weighed out according to the following formula: 195 g chromium powder, 3 g diphenyl, 1.5 g ammonium chloride, 100.5 g aluminium oxide. The weighed out components are dried: chromium powder at 140° C. for 4 h; diphenyl at 60° C. for 0.5 h; ammonium chloride at 140° C. for 4 h; aluminium oxide at 1200° C. for 2 h. Then the dried components are cooled to 20°–40° C. and thoroughly mixed.

After mixing, the composition contains the following components, mass %:

| | |
|---|---|
| chromium powder | 65 |
| diphenyl | 1.0 |
| ammonium chloride | 0.5 |
| aluminium oxide | 33.5 |

This composition is ready for use.

300 g of this composition is charged into a stainless steel container of 80 mm inside diameter, 110 mm high, wall thickness 5 mm. The specimens of carbon and alloyed steel 15 mm in diameter 5 mm high are immersed into said composition, arranging the specimens so that the distance between the container bottom and the specimens is 20 mm, the distance from the side walls of the container to the specimens in 10 mm, the distance between the specimens is 15 mm and that from the specimens to the first cover of the container, 30 mm.

After arranging the specimens in the composition, the container is closed with the first stainless steel cover and a layer of quartz sand 30 mm deep is poured on top of the cover. Then the second stainless steel cover of the container is closed and boric oxide is poured over it in a layer 10 mm deep. Now the container is placed into a resistance furnace, heated to 1080° C. and held at this temperature for 8 h. On expiration of this time the container is withdrawn from the furnace and cooled to room temperature. Then it is opened and the specimens are taken out and investigated by conventional methods to determine the physicomechanical and physicochemical properties of the produced diffusion carbide-chromium coating.

| Test results | |
|---|---|
| carbide coating | dense, i.e. practically without pores |
| surface roughess of coating Ra, max | 0.32 μm |
| thickness of carbide coating | 23.0 μm |
| microhardness of carbide coating | 25.5 GPa |
| hardness of base material | 5.4 GPa |
| minimum hardness in sub-layer (decarburized) zone | 5.4 GPa |
| relative wear rate of coating in sliding friction | 14.6 $g/m^2 \cdot s$ |
| corrosion resistance in 20% aqueous solution of $H_2SO_4$ | 0.0054% |
| cavitation resistance | 146 $mg/cm^2$ |

On completion of the process the composition is reclaimed.

EXAMPLE 2

The starting components are titanium powder, anthracene, ammonium fluoride, silicone dioxide.

The starting components are prepared as it is done in Example 1. 210 g of titanium powder, 7.5 g of anthracene, 15 g of ammonium fluoride and 67.5 g of silicone dioxide are thoroughly mixed. After mixing the composition contains the following components, mass %:

| | |
|---|---|
| titanium powder | 70 |
| anthracene | 2.5 |
| ammonium fluoride | 5.0 |
| silicone dioxide | 22.5 |

This composition is ready for use.

300 g of the composition is charged into the container described Example 1 and the specimens are arranged in the composition just as it is advised in Example 1.

The container is placed into a resistance furnace, heated to 1050° C. and held so for 6 h. Then the container is withdrawn from the furnace, cooled to room temperature and opened, the specimens are taken out and investigated to determine the physicomechanical and physicochemical properties of the produced carbide-titanium coating.

| Test results | |
|---|---|
| carbide coating | dense, i.e. practically without pores |
| carbide coating surface roughness Ra, max | 0.32 μm |
| thickness of carbide coating | 22.3 μm |
| microhardness of carbide coating | 26.8 GPa |
| hardness of base material | 7.2 GPa |
| minimum hardness in sublayer (decarburized) zone | 6.8 GPa |
| depth of decarburized zone | 5.8 μm |
| relative wear rate of coating in | 15.7 $g/m^2 \cdot s$ |
| corrosion resistance in 20% aquéous solution of $H_2SO_4$ | 0.0043% |
| cavitation resistance | 135 $mg/cm^2$. |

On completion of the process the composition is reclaimed.

EXAMPLE 3

The starting components are silicone powder, naphthalene, ammonium bromide, magnesium oxide.

The starting components are prepared as it is done in Example 120 g of silicone powder, 2.1 g of naphthalene, 4.5 g of ammonium bromide and 173.4 g of magnesium oxide are carefully mixed to produce the following composition, mass %:

| | |
|---|---|
| silicone powder | 40 |
| naphthalene | 0.7 |
| ammonium bromide | 1.5 |
| magnesium oxide | 57.8 |

This composition is ready for use.

300 g of this composition is charged into a container described in Example 1 and the specimens are arranged also as advised in Example 1.

The container is placed into a resistance furnace, heated to 1100 and held at this temperature for 4 h. Then the container is taken from the resistance furnace, cooled to room temperature and opened; the specimens are taken out and investigated for determining the physicomechanical and physicochemical properties of the produced carbide-silicone coating.

| Test results | |
|---|---|
| carbide coating | dense, i.e. practically without pores |
| surface roughness Ra, max | 23.5 μm |
| microhardness of carbide coating | 24.6 GPa |
| hardness of base material | 5.2 GPa |
| minimum hardness in sub-layer (decarburized) zone | 5.0 GPa |
| depth of decarburized zone | 3.2 μm |
| relative wear rate of coating in sliding friction | 15.9 $g/m^2 \cdot s$ |
| corrosion resistance in 20% aqueous solution of $H_2SO_4$ | 0.0055% |
| caviation resistance | 158 $mg/cm^2$. |

On completion of the process the composition is reclaimed.

EXAMPLE 4

The starting components are vanadium powder, pyrene, ammonium iodide, aluminium oxide.

The starting components are prepared similarly to Example 1. 195 g of vanadium powder, 3 g of pyrene, 1.5 g of ammonium iodide and 100.5 g of aluminium oxide are thoroughly mixed.

After mixing the composition contains the following components mass %:

| | |
|---|---|
| vanadium powder | 65 |
| pyrene | 1.0 |
| ammonium iodide | 0.5 |
| aluminium oxide | 33.5 |

This composition is ready for use.

300 g of this composition is charged into the container described in Example 1 and the specimens are arranged as in Example 1.

The container is placed into a resistance furnace and heated to 1060° C., holding it so for 6 h. Then it is withdrawn from the furnace and cooled to room temperature. The specimens taken from the container are investigated to determine the physicomechanical and physicochemical properties of the produced carbide-vanadium coating.

| Test results | |
|---|---|
| carbide coating | dense, i.e. practically without pores |
| surface roughness, max | 0.63 μm |
| thickness of carbide coating | 24.2 μm |
| microhardness of carbide coating | 25.7 GPa |
| hardness of base material | 6.3 GPa |
| minimum hardness in sublayer (decarburized) zone | 6.3 GPa |
| relative wear rate of coating in sliding friction | 15.5 $g/m^2 \cdot s$ |
| corrosion resistance in 20% aqueous solution of $H_2SO_4$ | 0.0043% |
| cavitation resistance | 144 $mg/cm^2$ |

On completion of the process the composition is reclaimed.

EXAMPLE 5

This example describes a known composition and its utilization for producing a diffusion carbide coating according to the Inventor's Certificate of the USSR No. 956615, Cl. C23C 9/02, 1982.

The composition is made up of the following components, mass %:

| | |
|---|---|
| chromium | 60 |
| Bondiuzhsky | 0.5 |
| ammonium chloride | 3.0 |
| aluminium oxide | 36.5 |

The Bondiuzhsky carburizer is a powder mixture consisting of the following components, mass %: charcoal, 74–78; $BaCO_3$, —12–15; $Na_2CO_3$, 1.0–1.5; $CaCO_3$, 3–5; fuel oil, 4.5–5.0; $H_2O$ under 6; S under 0.1; and $SiO_2$ under 0.5.

300 g of said composition is charged into a container as described in Example 1 and the diffusion carbide-chromium coating of specimens is produced as in Example 1.

The obtained carbide-chromium coating possesses the following physicomechanical and physicochemical properties:

| | |
|---|---|
| carbide coating | porous |
| coating surface roughness Ra not over | 16.6 μm |
| microhardness of carbide coating | 21.6 GPa |

-continued

| | |
|---|---|
| hardness of base material | 5.2 GPa |
| minimum hardness in sublayer (decarburized) zone | 4.2 GPa |
| depth of decarburized zone | 15.0 μm |
| relative wear rate of coating in sliding friction | 21.2 $g/m^2 \cdot s$ |
| corrosion resistance in 20% aqueous solution of $H_2SO_4$ | 0.0073% |
| cavitation resistance | 195 $mg/cm^2$ |

By comparing the physicomechanical and physicochemical properties of the coatings obtained from the herein-proposed and previously known compositions, it can be noted that the indices of the coating produced from the composition according to the invention are by far higher than those of the coating produced from the known composition. Thus, for example, the thickness of the carbide layer increases B 1.3–1.5 times, microhardness of the carbide layer, 1.1–1.3 times, wear resistance in sliding friction, 1.3–1.6 times, cavitation resistance, 1.2–1.4 times, the decarburized zone being practically nonexistent under this coating.

We claim:

1. A composition for depositing a diffusion carbide coating on iron-carbon alloy articles comprising a carbide-forming element in an amount of from 40 to 70%, a carbon-containing compound selected from the class of hydrocarbons having a boiling or sublimation point of 180° to 750° C. and which is in a solid state at room temperature in an amount of from 0.5 to 2.5%; an activator in an amount of from 0.2 to 5.0% and an inert filler in an amount of from 22.5 to 59.3%, wherein the carbide forming element is selected from the group consisting of chromium, molybdenum, tungsten, niobium, zirconium, tantalum, and silicone.

2. The composition according to claim 1 wherein the carbide-forming element is chromium.

3. The composition according to claim 1 wherein the carbide-forming element is tantalum.

4. The composition according to claim 1 wherein the carbide-forming element is silicon.

5. The composition according to claim 1 wherein the carbide-forming element is vanadium.

6. The composition according to claim 1 wherein the carbon-containing compound is diphenyl.

7. The composition according to claim 1 wherein the carbon-containing compound is naphthalene.

8. The composition according to claim 1 wherein the carbon-containing compound is anthracene.

9. The composition according to claim 1 wherein the activator comprises halogenen-containing ammonium salts.

10. The composition according to claim 1 wherein the inert filler is selected from the group consisting of alumina, magnesium oxide, and silica.

11. The composition, according to claim 1 wherein the composition in the form of a powder.

12. The composition according to claim 11 wherein the dispersity of particles of the powder is in the range of 16 to 12 mesh.

13. The composition according to claim 1 wherein the carbon containing compound is pyrene.

14. The composition according to claim 1 wherein the activator is selected from the group consisting of ammonium chloride, ammonium fluoride, ammonium bromide and ammonium iodide.

15. The composition according to claim 1 wherein the inert filler is kaolin.

16. The composition according to claim 1 wherein the inert filler is refractory clay.

* * * * *